US006592069B1

(12) United States Patent
Cobble

(10) Patent No.: US 6,592,069 B1
(45) Date of Patent: Jul. 15, 2003

(54) MINI-BEAM YARN SUPPLY APPARATUS AND METHOD

(76) Inventor: Dan Cobble, 2029 Lake Francis Rd., NE., Dalton, GA (US) 30721

( * ) Notice: Subject to any disclaimer, the term of this patent is extended or adjusted under 35 U.S.C. 154(b) by 41 days.

(21) Appl. No.: 09/587,935

(22) Filed: Jun. 6, 2000

(51) Int. Cl.[7] ..... B65H 75/18
(52) U.S. Cl. ..... 242/598; 242/598.5; 28/172.1
(58) Field of Search ..... 242/131.1, 131, 242/594.6, 598, 598.5, 129; 28/172.1, 190, 192

(56) References Cited

U.S. PATENT DOCUMENTS

| | | | | |
|---|---|---|---|---|
| 349,100 A | * | 9/1886 | Howard | 242/131.1 |
| 919,398 A | * | 4/1909 | Thornton | 242/594.6 |
| 3,848,829 A | * | 11/1974 | Womer | 242/131 |
| 4,629,143 A | * | 12/1986 | Griffin | 242/131 |
| 4,730,466 A | * | 3/1988 | Tenconi | 66/125 R |
| 5,033,173 A | * | 7/1991 | Hagewood | 28/190 |
| 5,451,006 A | * | 9/1995 | Smith | 242/131.1 |
| 5,492,152 A | * | 2/1996 | Kikuchi et al. | 242/131.1 |

FOREIGN PATENT DOCUMENTS

GB 2 191 788 A * 12/1987

* cited by examiner

*Primary Examiner*—Donald P. Walsh
*Assistant Examiner*—Joseph C Rodriguez
(74) *Attorney, Agent, or Firm*—Stephen J. Stark; Miller & Martin

(57) ABSTRACT

A beam rack utilizes a plurality of mini-beams located in substantially planar layer arrangements wherein the yarn ends are fed in substantially the same direction to directors which direct the yarn to a header. The mini-beams are stacked both horizontally and vertically in the beam rack. The beam rack preferably includes a bearing arm for supporting a plurality of mini-beams along bushings of the mini-beams.

The mini-beam is loaded with a warper wherein a plurality of yarn ends are preferably loaded on a single mini-beam. The yam ends can vary anywhere from one yarn to sixteen or more yarns per mini-beam depending on the number of mini-beams required to correspond with yarn feeds for a particular pattern. The yarn ends proceed from the mini-beams to the director, a header and on to a tufting machine.

22 Claims, 2 Drawing Sheets

MINI-BEAM YARN SUPPLY APPARATUS AND METHOD

BACKGROUND OF THE INVENTION

The present invention relates generally to devices which are utilized to supply yarn to tufting machines, and more specifically to a device and a method of using a plurality of mini-beams to supply a tufting machine with yarn.

DESCRIPTION OF RELATED ART

The traditional method of supplying a tufting machine with yarn has been to utilize a creel such as the creel disclosed in U.S. Pat. No. 5,613,643. Creels are generally frames which support a plurality of stationary yarn cones. A bolt of yarn, or yarn cone, is placed on a cone holder. An end of the yarn may then be directed through a guide and then to a yarn tube. From the tube, the yarn is typically directed to a header located at the top of the creel most adjacent to a textile machine being served. Yarn strands then exit the header and proceed to a particular needle for tufting through a fabric to create a pile product, such as a carpet. When a particular bolt of yarn is almost exhausted, another bolt of yarn may be placed on the cone holder in the creel and the ends of the yarn spliced together. The yarn cones utilized are typically provided by yarn companies in predetermined amounts of yarn.

A disadvantage of the use of yarn creels is that for a broad beam tufting machine, which may often have as many as 1,000 needles or more, in each of two rows, a separate yarn cone is necessary for each needle. The space required to accommodate 2,000 yarn cones is substantial which has led to many attempts to better utilize space, including placing yam creels on the second floor and feeding yarns down to a ground floor tufting machine.

One method developed to conserve space by eliminating the use of yam creels is the use of a warper and beam. In this system, one yam creel is used to hold all the yams that would be fed to approximately 100 to 150 needles. A large roll or "beam" is mounted in a drive known as a warper and is wound with a predetermined amount of yarn from each of the yam cones in the creel, so over one hundred separate ends of yarn are on the beam. The beam may then be placed adjacent to a tufting machine and the yams from the beam threaded to needles across the tufting machine. In this fashion approximately six beams take the place of a much larger yam creel assembly. Unfortunately, the use of a beam of this type is limited because all of the yams must feed at the same rate. As a result, these regular size beams are not generally suitable for use with tufting machines utilizing pattern attachments.

B & J Machinery Co., Inc., of Dalton, Ga., has previously marketed a mini-beam rack with yam tubes, illustrated in FIG. 3, which employed the use of mini-beams. Mini-beams could be wound on a warper and placed in the specially designed beam rack. The beam rack of this design utilized a plurality of tubes disposed to receive yarn from a given mini-beam. The tubes directed the yarn from the mini-beams to a header for delivery to a specific tufting machine.

The use of a plurality of mini-beams allowed each mini-beam to be wound on a warper with only about a dozen yarns. The yarns from one mini-beam could be directed to a single set of yarn feed rolls on a scroll-type pattern attachment, typified by that in U.S. Pat. No. 5,983,815. In this fashion between about 60 and 144 mini-beams could supply yarns to a pattern attachment as each mini-beam would more independently depend upon the yarn requirements for its corresponding pattern attachment yam feeder rolls.

The prior art rack design was similar to a creel in that it incorporated tubes which directed yarn to a header and then on to a tufting machine. This design was loaded with mini-beams from within the rack. On any given plane of mini-beams, the yams were directed towards the tufting machine from one set of mini-beams and away from the tufting machine by the other set of mini-beams. The tubes then directed the yarns towards a header for use by the tufting machine. By having multiple sets of mini-beams directing a plurality of yams away from the tufting machine, a relatively large quantity of tubing was required to redirect yam back towards the tufting machine. Additionally, the prior art beam rack design took up a considerable amount of space, similar to a creel.

When yarn tubes are present, an operator must direct a yarn through the tubing, usually from the header to the point nearest the yarn supply. This process may be accomplished utilizing compressed air to blow a guide yarn down each yarn tube. Once the yarn is blown through the tube, it connected to the yarn supply and yarns from the yarn supply can be pulled back through the tubing and the header. The yarn from the yam supply is then connected to the needle in the tufting machine. The process must then be repeated for every tube connected to the header. This process would be greatly simplified by removing, or reducing, the number of tubes. Accordingly, a need exists for a beam rack which does not require the use of yarn tubes.

The mini-beams of the prior art design have also been improved upon by the mini-beam illustrated in FIG. 2. The prior art mini-beams had a similar overall appearance, however, the prior art mini-beams rested in the rack of FIG. 3 on smaller diameter extension members instead of on a larger diameter bushing. Accordingly, when a tufting machine would slow down there was very little friction between the mini-beam and the beam rack. There was a tendency for the inertia of the mini-beam, especially when heavily loaded with yarn, to maintain mini-beam's rotational speed when the tufting machine slowed. This resulted in yarn unwinding off the mini-beam without being taken up by the tufting machine. This yarn could sag external to the tubes and become tangled. Accordingly, a need exists to reduce the risk of possible entanglement of yarn.

Furthermore, each prior art beam rack was designed to be utilized with a particular tufting machine pattern attachment. The tubes provided a specific yarn to a specific header location to feed a particular yam feed module of the yarn feed pattern attachment of the tufting machine. If a different pattern attachment were desired to be used, another beam rack having the correct tube and header configuration would be necessary. This made each prior art mini-beam rack useful only with pattern attachments of a single manufacturer and mini-beam racks could not be freely interchanged between machines.

Accordingly, a need exists to provide a beam rack which may supply a textile machine with a plurality of yarns from mini-beams wherein the beam rack is flexibly adaptable for a variety of textile machines and/or patterns.

Numerous alternations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

SUMMARY OF THE INVENTION

The beam rack of the preferred embodiment utilizes a plurality of mini-beams. The mini-beams are preferably located in substantially planar layer arrangements wherein all the yam ends are fed in a forward direction to director which guides or orients the yarn toward a header. The mini-beams are stacked both horizontally and vertically in the beam rack. The beam rack preferably includes a bearing arm for supporting a plurality of mini-beams along bushings of the mini-beams.

Each mini-beam is loaded with a warper wherein a plurality of yarn ends are usually loaded on a single mini-beam. The number of yarn ends can vary anywhere from a single yarn to sixteen or more yarns per mini-beam depending on the pattern to be tufted on a particular tufting machine. In the usual case, there is at least one yarn end for each repeat of the pattern, and a typical broad loom tufting machine may have as many as sixteen pattern repeats. The yarn ends will usually proceed from the mini-beams to a pattern attachment feeding into a tube bank and then to the needles of the tufting machine.

DETAILED DESCRIPTION OF THE PREFERRED EMBODIMENT

Figure 1:
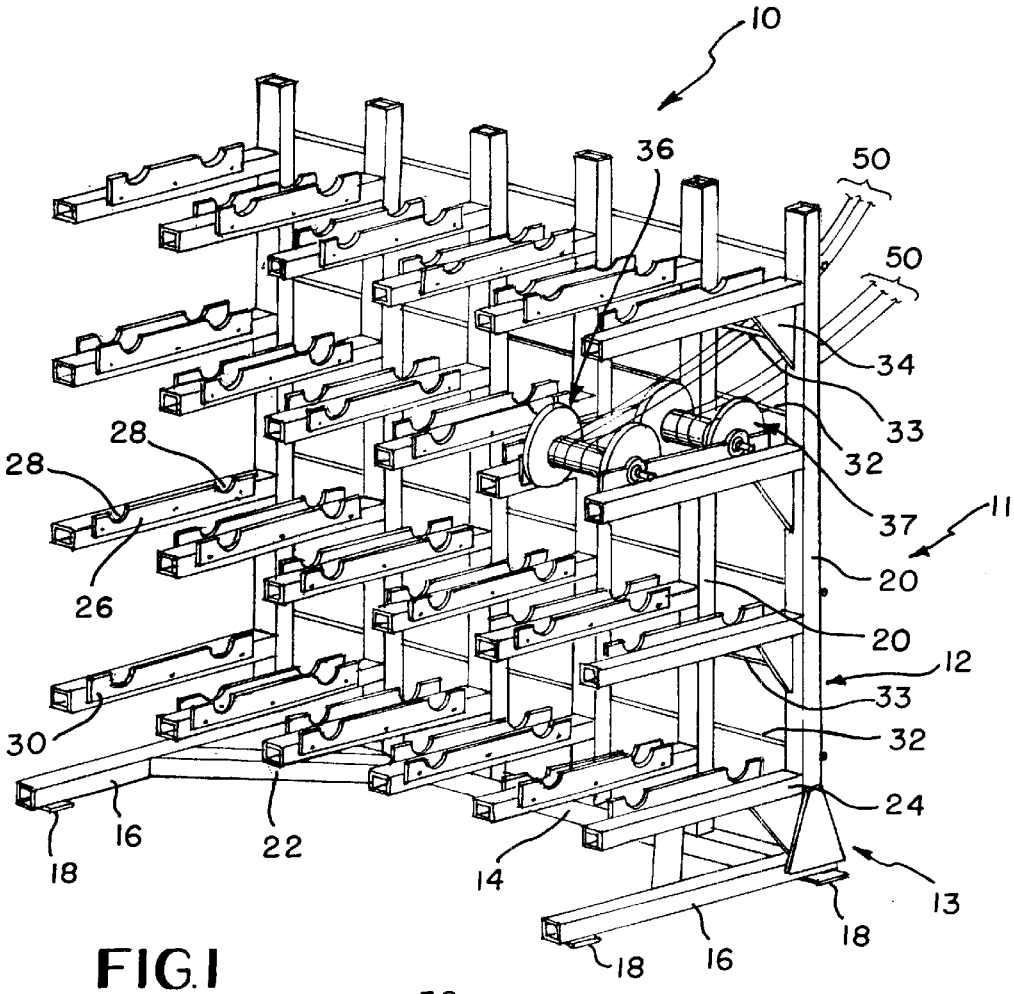
FIG. 1 is a perspective view of a beam rack supporting two mini-beams according to the present invention with two mini-beams in position.

Accordingly, FIG. 1 is a perspective view of the beam rack 10 of the preferred embodiment. The beam rack 10 has a frame 11 comprised of a support section 12 and a base 13. The base 13 may include a base member 14 and rearwardly extending legs 16. The support section 12 may include supports 20 and directors 32. The support section 12 is mounted upon base 13. The directors 32 may assist in providing lateral stability to the support 20 of support section 12.

The legs 16 of the base 13 preferably include feet 18. The feet 18 may include roller mechanisms and wheel locks to allow for the easy movement of the beam rack 10.

The legs 16 preferably connect to the base member 14 as illustrated in FIG. 1. Braces 22 may also be utilized to connect the legs 16 to the base member 14.

The supports 20 of the support section 12 are illustrated as being connected to base 13. Preferably, the supports 20 are connected to the base member 14.

Connected to the supports 20 are outwardly extending arms 24 and, preferably, arm supports 34. The arms 24 preferably extend from a rear side of the supports 20 to provide mounts for the rear and front mini-beams 36, 37. The legs 16 of the base 13 extend from the rear side of the support section 12, as do the arms 24 in order to prevent the beam rack 10 from tipping about the base 13. Alternatively arms could extend both forwardly and rearward of the support section 12. This alternative arrangement could facilitate placing mini-beams in the beam rack 10, but would slightly complicate feeding of yarns.

Figure 2:
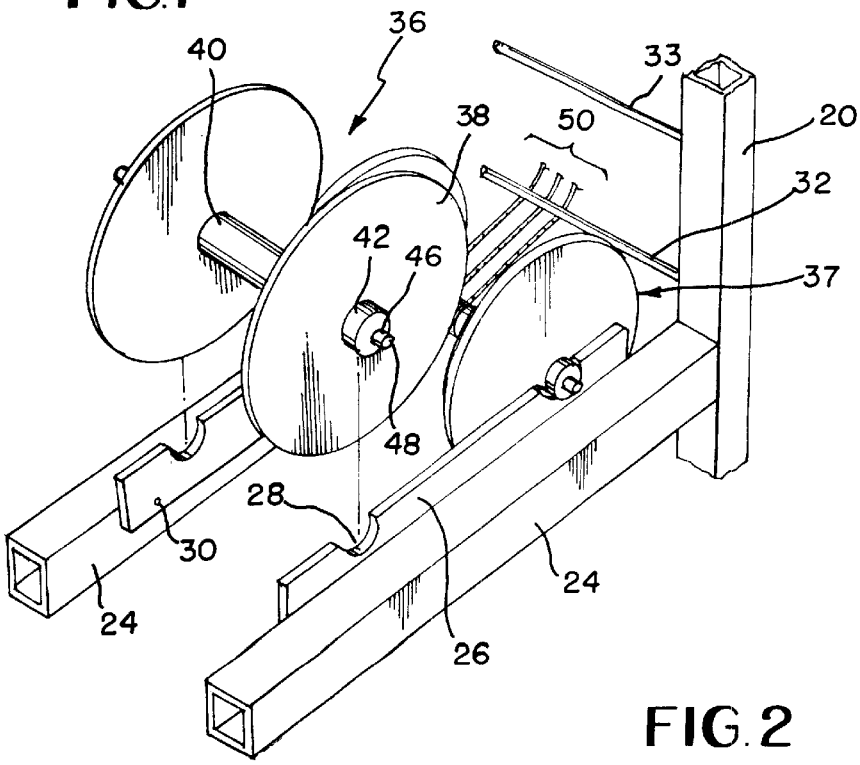
FIG. 2 is a perspective view of two mini-beams relative to a pair of arms according to the present invention.

As may best be seen in FIG. 2, the inner surfaces of arms 24 are preferably provided with bearing arms 26. At least a portion of the bearing arms 26 are preferably constructed of a material such as ultra high molecular weight polyethylene (UHMW) or any other bearing-type material. Alternatively, the bearing arms 26 may support bearings which cooperate with or are mounted upon the mini-beams 36, 37. Connectors 30 may be utilized to connect the bearing arms 26 to the arms 24. Connectors 30 may be any acceptable fastener such as screws and the like. Alternatively bearing arms 26 could be adhered or otherwise connected to arms 24.

The bearing arms 26 preferably contain mini-beam positioning locators such as beam supports 28. The beam supports 28 of the preferred embodiment are hemispheric cutouts in the bearing arms 26. Since bearing arms 26 are preferably constructed of a bearing type material, the cutouts provide a surface which retains the mini-beams 36, 37 in a desired location while allowing rotational movement of the mini-beams 36, 37. As can be seen in both FIGS. 1 and 2, a plurality of beam supports 28 may be located on a single bearing arm 26.

The mini-beams 36, 37 are illustrated in detail in FIG. 2. The mini-beams 36, 37 are preferably comprised of a pair of spaced apart discs 38 connected by an axis such as cylinder 40. A rod 48 may extend through the cylinder 40 and discs 38 to retain the relationship of the discs 38 to the cylinder 40 as well as to one another. Fastening bushings 42 may be utilized to secure to the discs 38 and the cylinder 40. The rod 48 may extend a distance beyond the bushings 42 to form extensions 46. Similar extensions were utilized in the prior art mini-beams to provide an interface with the mini-beam supports of the prior art design illustrated in FIG. 3 to allow the mini-beams to rotate relative to the supports. Fastening bushings were not utilized in the prior art design. Instead fasteners, which were nuts having planar sides, secured the discs 38 to the cylinder 40. Additionally, the rod 48 and the cylinder 40 may be integral to one another.

Referring back to FIG. 2, the bushings 42 of the preferred embodiment are round and of a larger diameter than the extensions 46. The increased diameter of the bushings 42 increases the surface area which interfaces with the beam supports 28 of bearing arms 26 to provide sufficient friction to reduce the effects of inertia on rotating mini-beams 36, 37. Prior art mini-beams rotating only on relatively small diameter extensions tended to rotate too freely relative to the inertia of the mini-beam and would sometimes unwind excess yarns.

Referring back to FIG. 1, rear and front mini-beams 36, 37 are illustrated supported by a pair of bearing arms 26. Each of these mini-beams 36, 37 direct at least one, and preferably a plurality of yarn ends 50, in a general forward direction. Although only three yarn ends 50 are illustrated extending from each mini-beam 36, 37 in FIG. 1, it is anticipated that as many as sixteen or more yarn ends may be utilized with each mini-beam 36, 37. The yarn ends 5O preferably proceed from the cylinder 40 to the director 32 or 33 where they are further directed towards a tufting machine pattern attachment header. The directors 32, 33 of the preferred embodiment are cylindrical rods. The directors 32, 33 preferably contact the yarn 50 and change, or angle, the direction of the yarn as it is fed off of the mini-beams 36, 37 thereby redirecting the yarn 50 towards the header. An outer surface of the directors 32, 33 may have a smooth surface portion for cooperating with the yarn 50 to change the direction of the yarn 50 without unduly wearing the yarn 50. Alternatively, the directors 32, 33 may rotate, such as on bearings, to reduce wear to the yarn 50. Rotating directors 32, 33 may have textured surfaces.

The arrangement of the mini-beams 36, 37 in the arrayed, or vertical and horizontal stacking fashion illustrated in FIG.

1, allows for an operator to relatively quickly direct yarn ends 50 from the mini-beams 36, 37 to a particular location on a header, if utilized, which may be located between the beam rack 10 and a tufting machine pattern attachment.

Figure 3:
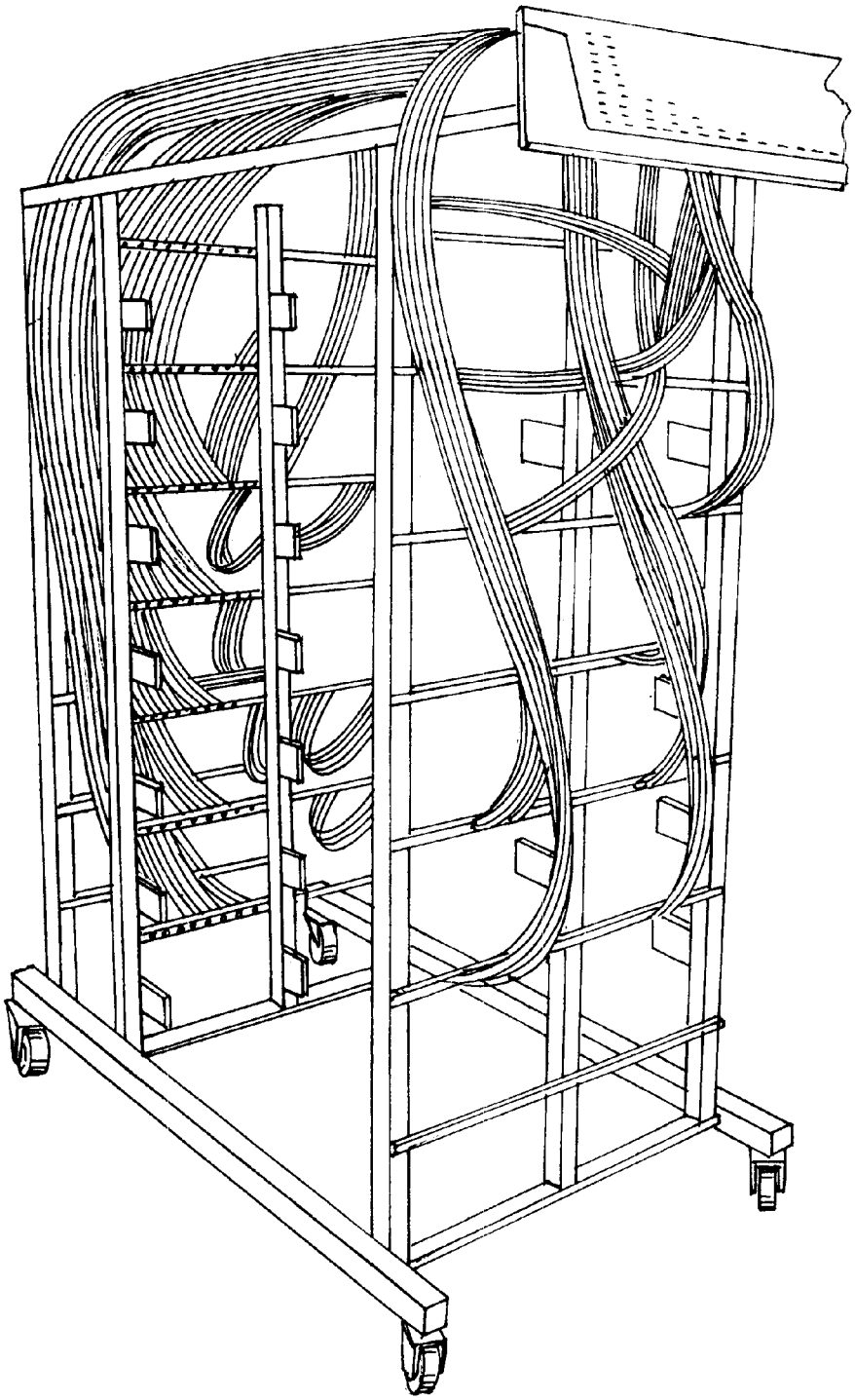
FIG. 3 PRIOR ART
FIG. 3 is a perspective view of a prior art mini-beam rack.

Pairs of vertically stacked mini-beams were utilized in the prior art in the beam rack design illustrated in FIG. 3. Tubes were utilized to direct the yarn upwards to a header. However, the rearward mini-beams in the prior art beam rack fed yarns in tubes rearward and then over the beam rack while the forward mini-beams fed yarns in the tubes forward and up to the header. This resulted in different tube lengths and different yarn drag for forward and rearward facing mini-beams. In FIG. 1, rear mini-beam 36 is illustrated in a first vertical plane farther away from directors 32, 33 than a second vertical plane including forward mini-beam 37. Mini-beams 36, 37 may also be located along a horizontal plane as mini-beams 36, 37 are illustrated in FIG. 1. Both rear and forward mini-beams 36, 37 feed yarns 50 in the forward direction. The mini-beams 36, 37 may rotate in a clockwise direction to unidirectionally feed yarns 50. The unidirectional feeding of yarns 50 have generally been found to eliminate the need to use tubing to direct yarn to a header. If tubing were desired to be used, with the unidirectional yarn feeding, the tubing lengths could be more equal and prevent the substantial variance in drag imposed on the yarns.

In the preferred embodiment the yarn is directed from the mini-beams 36, 37, past the corresponding directors 32, 33, to an appropriate location such as a header directing bar, or other guide, located either on the beam rack 10 or on a yarn feed pattern attachment. This design eliminates the steps of blowing air in the tubes to direct yarn through the tubes. As yarn is delivered from the mini-beams 36, 37 to a yarn feed pattern attachment, the mini-beam 36, 37 rotates relative to the arms 24. In the preferred embodiment illustrated in Figures 1 and 2, the mini-beams 36, 37 rotate in the cutouts, or beam supports 28, of the bearing arms 26.

Additionally, when the tubes are not a part of the beam rack 10, the beam rack 10 has the flexibility to be easily utilized with a variety of pattern attachments.

Arms 24 of the beam Tack 10 are preferably spaced apart in a vertical direction a distance sufficient to allow for mini-beams 36, 37 to be positioned on the beam supports 38 and allowing for the yarn ends 50 to be directed away from the beam rack 10 unobstructed by the beam rack towards the directors 32, 33, a tube, a header, or other structure prior to being delivered to a yarn feed attachment. Preferably the yarn ends 50 contact the directors 32, 33 and proceed to a header.

Beam racks 10 of the preferred embodiment locate mini-beams 36, 37 in arrays. Preferably arrays of mini-beams include at least two mini-beams in depth, namely a rear mini-beam 36 and a fore mini-beam 37. Additionally arrays of mini-beams include a plurality of mini-beams 36, 37 in a vertical arrangement, approximately corresponding to a height, as well as a plurality of mini-beams across, approximately corresponding to a width. The array formation has been found helpful in providing a plurality of mini-beams in a relatively small space. Additionally, an array need not include a mini-beam on every location of the array (i.e., one example could be two mini-beams 36, 37 across, two mini-beams high, and some of the mini-beams 36 omitted).

The beam rack 10 of the preferred embodiment is ideally suited for short production run situations where the pattern being produced at a particular time will only be run for a single shift. The beam rack 10 may be loaded expeditiously compared to loading a creel. Furthermore, the beam rack 10 may be extremely useful with sample machines, and small yarn lots, and scroll-type patterns. For textiles made to order, the beam rack 10 allows for rapid placement of yarns in a desired location for use with a textile machine, providing a time saving alternative to the yarn supply choices of the prior art. Additionally, a beam rack 10 could be utilized in combination with a creel, so that each device is configured to supply certain needles with yarn. This is particularly attractive for certain related carpet designs which are produced identically except for changing colors or accent yarns. In this case, the beam rack 10 may be utilized solely for the accents so that the colors could be easily changed. Of course, it is contemplated that in most situations the beam rack 10 will totally replace creels.

The beam rack 10 allows a user to reduce the quantity of yarn maintained by the textile producing company. Specifically, when using creels, the textile machine operator must maintain at least one cone of every color utilized for a particular textile product. This could easily exceed 1,000 yarn cones of a particular color yarn. Furthermore, a cone must be present for each needle in the tufting machine. When utilizing the beam rack 10, mini-beams 36, 37 are loaded from a source of colored yarn with a warper. The number of yarn cones required is only the number of yarns of a single color being wound on a single mini-beam in the preferred embodiment, thus eliminating the need to have an excess quantity of yarn cones on hand.

Utilizing a warper, a mini-beam 36, 37 may be loaded in approximately four to sixteen minutes depending on the number of yarn ends which will be utilized from the mini-beam. Furthermore, multiple warpers may be utilized to rapidly load mini-beams 36, 37 for use with the beam rack 10. Additionally, warpers may be loading one set of mini-beams 36, 37 while another set of mini-beams 36, 37 is in use on a beam rack 10.

A warper may load the mini-beams of the preferred embodiment with five yarn ends with about 4000 yards of yarn each. About twelve yarn ends may be loaded onto a single mini-beam 36, 37 with about 2200 yards of yarn each. When the mini-beams 36, 37 are utilized with a tufting machine, a ratio of about 5:1 has been achieved for the ratio of yarn loaded versus yards of carpet produced. Factors such as the gauge of machine, the width of repeat, the backing feed rate, the number of yarn ends utilized on a particular machine, and the number of mini-beams 36, 37 will effect the yardage of textile produced from a loaded beam rack, however, one or two typical loaded beam racks 10 will support the operating of a tufting machine for about an eight hour shift.

The preferred warper assemblies will comprise between about three to about eight individual warpers so that about three to eight mini-beams may be loaded simultaneously. A broad loom tufting machine will typically require between about 48 and 144 mini-beams, as a separate mini-beam is required for each set of yarn feed rolls being utilized in the yarn feed pattern attachment.

Numerous alternations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

What is claimed is:

1. A yarn supply device comprising:

at least two mini-beams, each of said mini-beams having a cylinder with a plurality of independent yarn strands wound thereabout; and a rack for use with a yarn feed pattern attachment, said rack comprising a base;

a support section connected to the base, said support section having a plurality of arms extending outward from said support section;

a pair of said plurality of arms supporting said at least two mini-beams at opposing ends of the mini-beams;

said cylinders of said mini-beams rotatable relative to said plurality of arms and each of said mini-beams directing their plurality of yarn strands, each of the yarn strands beginning with a yarn end, in the same direction; and whereby rotation of the mini-beam dispenses the plurality of yarn strands at the same rate.

2. The yarn supply device of claim 1 wherein the cylinder of said mini-beams direct the yarn ends of their plurality of yarn strands in a forward direction.

3. The yarn supply device of claim 1 wherein said mini beams both rotate in a clockwise direction in directing their yarns.

4. The yarn supply device of claim 1 wherein the yarn feed pattern attachment is a scroll-type attachment and a single yarn end is fed to a different location on the scroll-type attachment.

5. The yarn supply device of claim 1 further comprising a first director, wherein said plurality of yarn strands from a first of the at least two mini-beams proceed in a first linear direction to contact with said first director and then proceed from the first director toward the yarn feed pattern attachment from the first director in a second linear direction, said first linear direction angled relative to said second linear direction.

6. The yarn supply device of claim 5 further comprising a second director, wherein said at least one yarn strand from a second of the at least two mini-beams proceeds towards and contacts the second director, and said second director further comprises a curved exterior surface.

7. The yarn supply device of claim 6 where at least a portion of the second director rotates where said plurality of yarn strands from the second mini-beam contact the second director.

8. The yarn supply device of claim 5 wherein the support section further comprises at least two vertical supports and said first director is connected to said at least two vertical supports.

9. The yarn supply device of claim 1 further comprising a pair of beam arms having beam supports, said beam arms connected to a said plurality of arms, said beam arms supporting said mini-beams.

10. The yarn supply device of claim 9 wherein the beam supports further comprise a bearing-type material in contact with a portion of the mini-beam.

11. The yarn supply device of claim 9 wherein the beam supports are cutouts in the beam arms.

12. The yarn supply device of claim 1 wherein the base further comprises legs, said legs extending outward from the base.

13. The yarn supply device of claim 1 wherein the base further comprises a lockable roller mechanism allowing the rack to be moved to a desired position.

14. The yarn supply device of claim 1 wherein the mini-beams further comprises spaced apart discs connected to the cylinder, and said at least one yarn strand is located between said discs.

15. The yarn supply device of claim 14 further comprises bushings external to the discs wherein said bushings cooperate with beam supports connected to the arms allowing the mini-beams to rotate relative to the arms.

16. A yarn supply device for use with a tufting machine comprising:

a plurality of mini-beams, each of said mini-beams having a cylinder with at least two separate yarn strands wound thereabout; and a rack comprising a base;

an upstanding support section connected to the base, said support section having a plurality of outwardly extending arms, said plurality of arms supporting a rearward and a forward of said plurality of mini-beams;

wherein said rearward and forward mini-beams are rotatable relative to said plurality of arms and direct their at least two separate yarn strands forward; and wherein said plurality of mini-beams are arranged in an array having at least two heights.

17. The yarn supply device of claim 16 wherein the array comprises at least two of said plurality of mini-beams in width.

18. A yarn supply device for use with a textile machine comprising:

a front mini-beam having a cylinder with a plurality of separate yarn strands wound thereabout; and a rack comprising a base;

a support section connected to the base, said support section having at least a pair of outwardly extending arms, said arms supporting said mini-beam;

said cylinder of said mini-beam rotatable relative to said arms and directing said plurality of separate yarn strands in a forward linear direction to a director having a curved exterior surface; and wherein said director contacts said plurality of yarn strands at least one point along said curved exterior surface and said yarn strands continue in a second linear direction, said forward linear direction angled relative to said second linear direction.

19. The yarn supply device of claim 18 wherein said curved exterior surface is smooth at a location where said at least one yarn strand connects the director.

20. The yarn supply device of claim 18 wherein said director rotates where said at least one yarn strand contacts said director.

21. The yarn supply device of claim 18 further comprising a second mini-beam, said second mini-beam located on said pair of arms with said first mini-beam, said second mini-beam directing at least one strand of yarn to a second director.

22. A yarn feed device for use with a yarn feed pattern attachment comprising:

at least two mini-beams, each of said mini-beams having a cylinder with at least two yarn strands wound thereabout;

a rack comprising a base, a support section connected to the base, a means for locating said first and second mini-beams on the rack so that the first mini-beam is located forward of the second mini-beam having arms cantilevered from the support section, and a means for simultaneously directing the at least two yarn strands from each of the first and second mini-beams forward and out of the beam rack to the yarn feed pattern attachment wherein rotation of the cylinder delivers the at least two yarn strands simultaneously from the cylinder to the yarn feed pattern attachment.

* * * * *